US007331266B2

(12) United States Patent
Chen

(10) Patent No.: US 7,331,266 B2
(45) Date of Patent: Feb. 19, 2008

(54) PAPER PUNCH WITH TWO ARTICULATED LINKAGES

(75) Inventor: Jau-Shyong Chen, Chang Hua (TW)

(73) Assignee: SDI Corporation, Chang Hua (TW)

( * ) Notice: Subject to any disclaimer, the term of this patent is extended or adjusted under 35 U.S.C. 154(b) by 299 days.

(21) Appl. No.: 11/271,756

(22) Filed: Nov. 14, 2005

(65) Prior Publication Data

US 2007/0107576 A1 May 17, 2007

(51) Int. Cl.
*B26D 5/10* (2006.01)

(52) U.S. Cl. ..... 83/633; 83/687

(58) Field of Classification Search ..... 83/651, 83/633, 634, 687, 691
See application file for complete search history.

(56) References Cited

U.S. PATENT DOCUMENTS 1,362,604 A * 12/1920 Czaran ..... 83/387
2,001,161 A * 5/1935 Snyder et al. ..... 83/633
2,200,672 A * 5/1940 Kern ..... 83/167
4,092,005 A * 5/1978 Benroth ..... 241/168
4,713,995 A * 12/1987 Davi ..... 83/167
5,273,387 A * 12/1993 Groswith et al. ..... 412/40
6,513,413 B2 * 2/2003 Lee ..... 83/633

* cited by examiner

*Primary Examiner*—Kenneth E. Peterson
*Assistant Examiner*—Sean Michalski
(74) *Attorney, Agent, or Firm*—Rosenberg, Klein & Lee

(57) ABSTRACT

A paper punch has a base, two cutters, two articulated linkages and a lever. The base has a top, an open bottom, a cavity, two punch holes and two brackets. The punch holes are defined through the top. The brackets are mounted on the top and each bracket has two guide slots. The cutters are slidably mounted respectively in the brackets and each cutter has a blade. The articulated linkages are pivotally mounted respectively on the brackets and each has a lower link and an upper link. The lower link is mounted pivotally and slidably on a corresponding bracket. The upper link is mounted pivotally on a corresponding lower link. The lever is mounted pivotally on the brackets and is connected pivotally to the upper links of the articulated linkages. The articulated linkages allow a user to press the lever without strenuous effort when punching holes through paper sheets.

2 Claims, 7 Drawing Sheets

PAPER PUNCH WITH TWO ARTICULATED LINKAGES

BACKGROUND OF THE INVENTION

1. Field of the Invention

The present invention relates to a paper punch, and more particularly to a paper punch that has two articulated linkages to allow people to easily punch holes through a stack of the paper sheets without strenuous effort.

2. Description of the Related Art

Paper punches are used to punch holes in paper sheets so the sheets can be mounted in a loose-leaf binder through the punched holes in the paper sheets.

A conventional paper punch has a base, a lever, two springs and two cutters.

The base is hollow and has a top, an open bottom, a cavity and two punch holes. The open bottom is covered with a detachable cover. The cavity is defined in the base and communicates with the open bottom. The punch holes are defined through the top.

The lever is mounted pivotally to the top of the base and has a proximal end and a distal end. The proximal end is attached pivotally to the top of the base. The distal end is pressed down to activate the paper punch.

The springs are mounted between the proximal end of the lever and the top of the base and provide a resilient force to pivot the lever upward.

The cutters are connected to the lever, are movable vertically relative to the base, and are aligned respectively with the punch holes in the base. Each cutter has a top end, a bottom end and a blade formed on the bottom end.

When holes are punched through paper sheets placed between the base and the cutters, the lever is pressed to cause it to pivot and move the cutters down through the paper and the punch holes in the base, simultaneously punching two holes through each paper sheet.

However, when a user punches holes through a thick stack of paper sheets using a conventional paper punch, strenuous effort is usually necessary due to an insufficient length of the lever to produce enough force for the blades of the cutters to cut through simultaneously.

To overcome the shortcomings, the present invention provides a paper punch with two articulated linkages to mitigate or obviate the aforementioned problems.

SUMMARY OF THE INVENTION

The main objective of the invention is to provide a paper punch that has two articulated linkages to allow a user to easily punch holes through a stack of paper sheets without strenuous effort.

A paper punch in accordance with the present invention comprises a base, two cutters, two articulated linkages and a lever.

The base has a top, an open bottom, a cavity, two punch holes and two brackets. The punch holes are defined through the top. The brackets are mounted on the top and each bracket has two guide slots.

The cutters are slidably mounted respectively in the brackets and each cutter has a blade.

The articulated linkages are pivotally mounted respectively on the brackets. Each articulated linkage has a lower link and an upper link. Each lower link is mounted pivotally and slidably on a corresponding bracket. Each upper link is mounted pivotally on a corresponding lower link.

The lever is mounted pivotally on the brackets and is connected pivotally to the upper links of the articulated linkages.

Other objectives, advantages and novel features of the invention will become more apparent from the following detailed description when taken in conjunction with the accompanying drawings.

DETAILED DESCRIPTION OF PREFERRED EMBODIMENT

Figure 1:
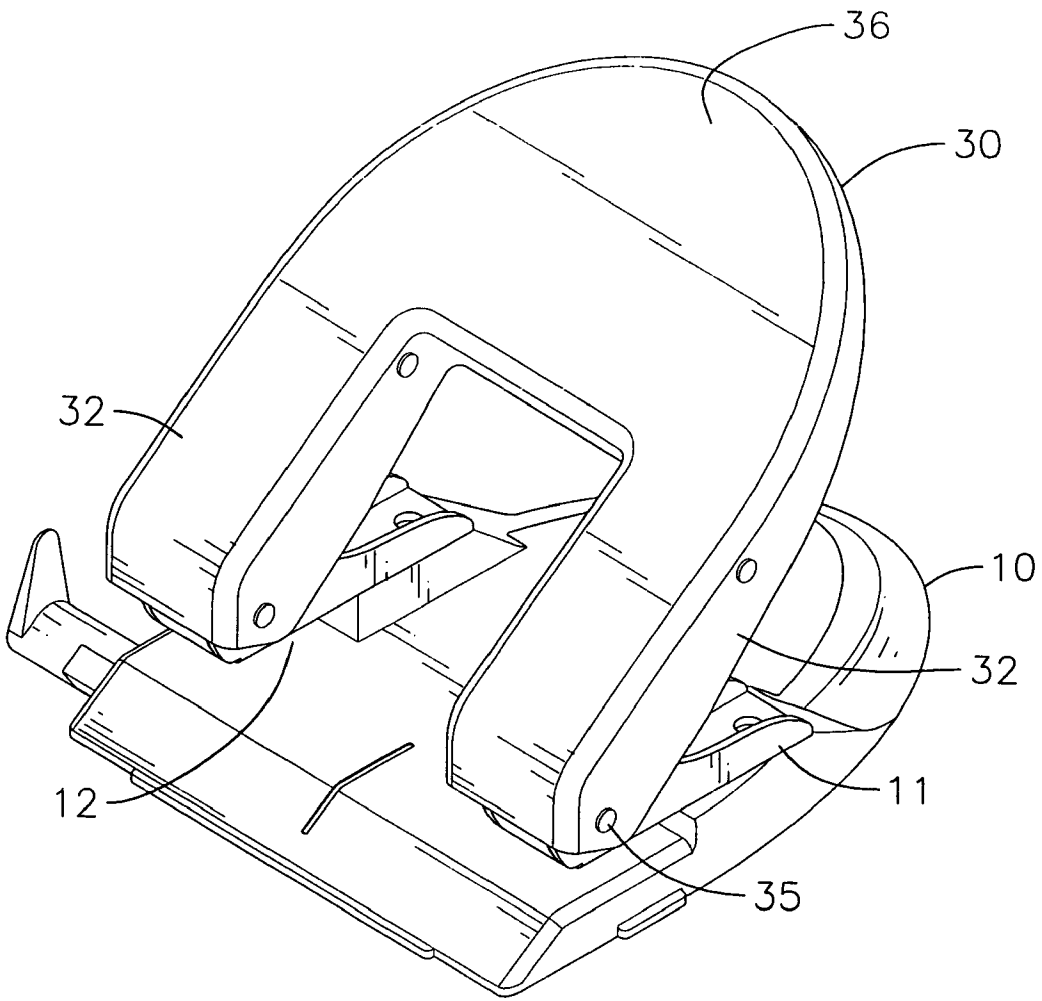
FIG. 1 is a perspective view of a paper punch in accordance with the present invention.
Figure 2:
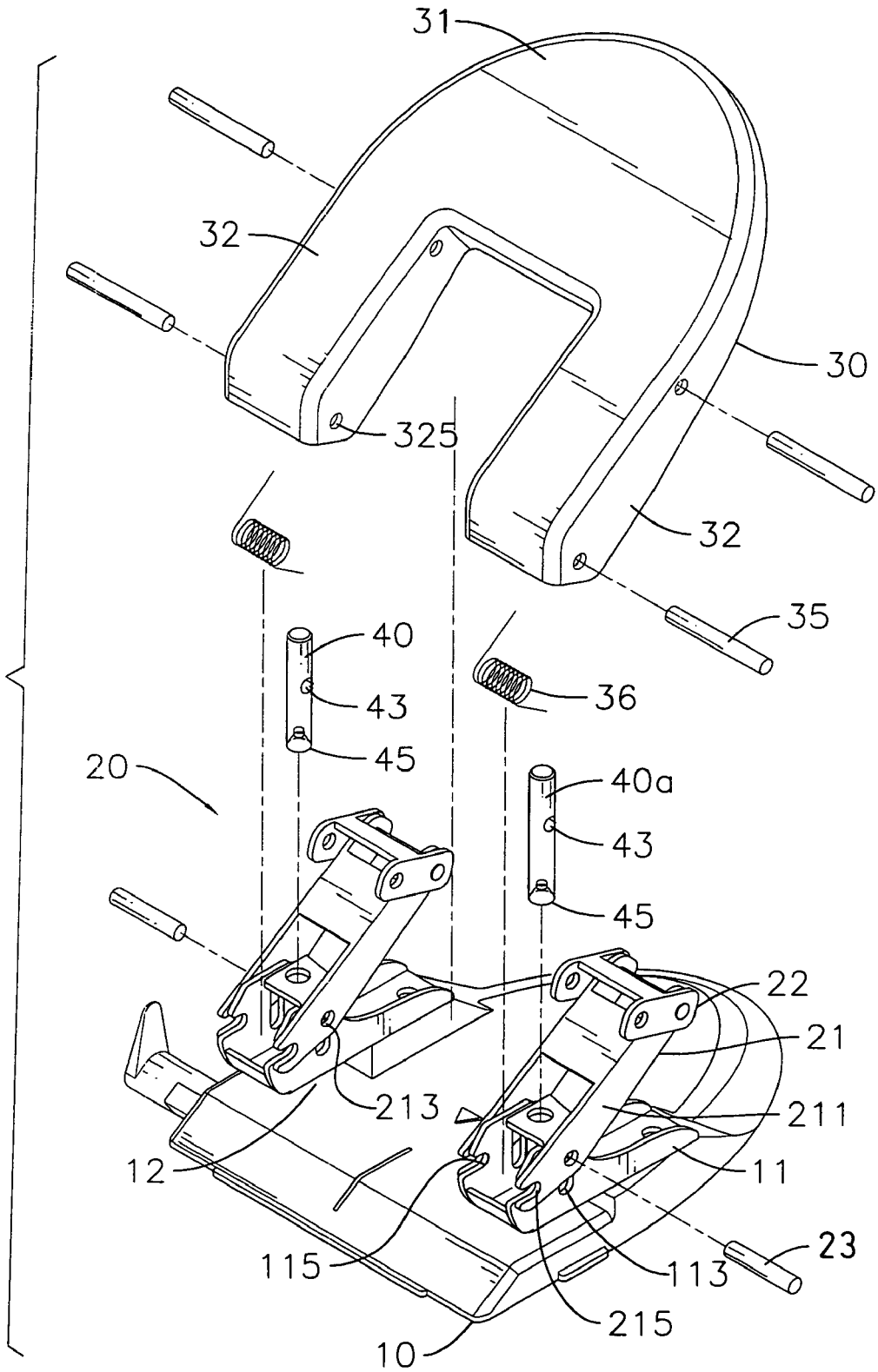
FIG. 2 is an exploded perspective view of the paper punch in FIG. 1.

With reference to FIGS. 1 and 2, a paper punch in accordance with the present invention comprises a base (10), two cutters (40, 40*a*), two articulated linkages (20) and a lever (30).

Figure 4:
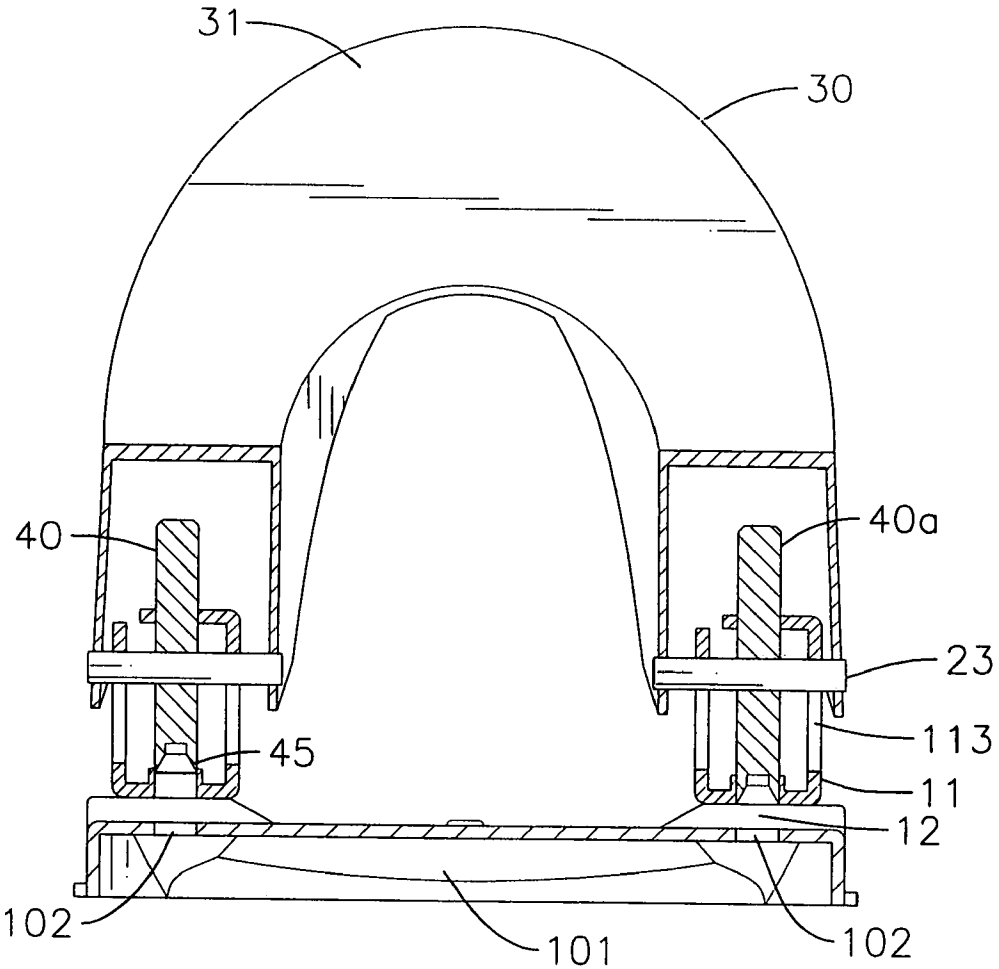
FIG. 4 is a cross-sectional front view of the paper punch in FIG. 1.

With further reference to FIG. 4, the base (10) is hollow, is used with a detachable cover and has a top, an open bottom, a cavity (101), two punch holes (102), two brackets (11) and two gaps (12).

The detachable cover covers the open bottom.

The cavity (101) is defined in the base (10), communicates with the open bottom and may contain cut scraps from paper sheets.

The punch holes (102) are defined through the top and communicate with the cavity (101).

The brackets (11) are mounted on the top and each bracket (11) has a bottom, two side tabs, a through hole, two guide slots (113) and two open pivot slots (115). Each side tab has a front end. The through hole is defined through the bottom of the side tab and is aligned with a corresponding punch hole (102) in the base (10). The guide slots (113) are defined respectively through the side tabs. The open pivot slots (115) are defined respectively in the front end of the side tabs.

The gaps (12) are defined respectively between the bottom of each bracket (11) and the top of the base (10) and allow paper sheets to be placed in the gaps (12).

Figure 5:
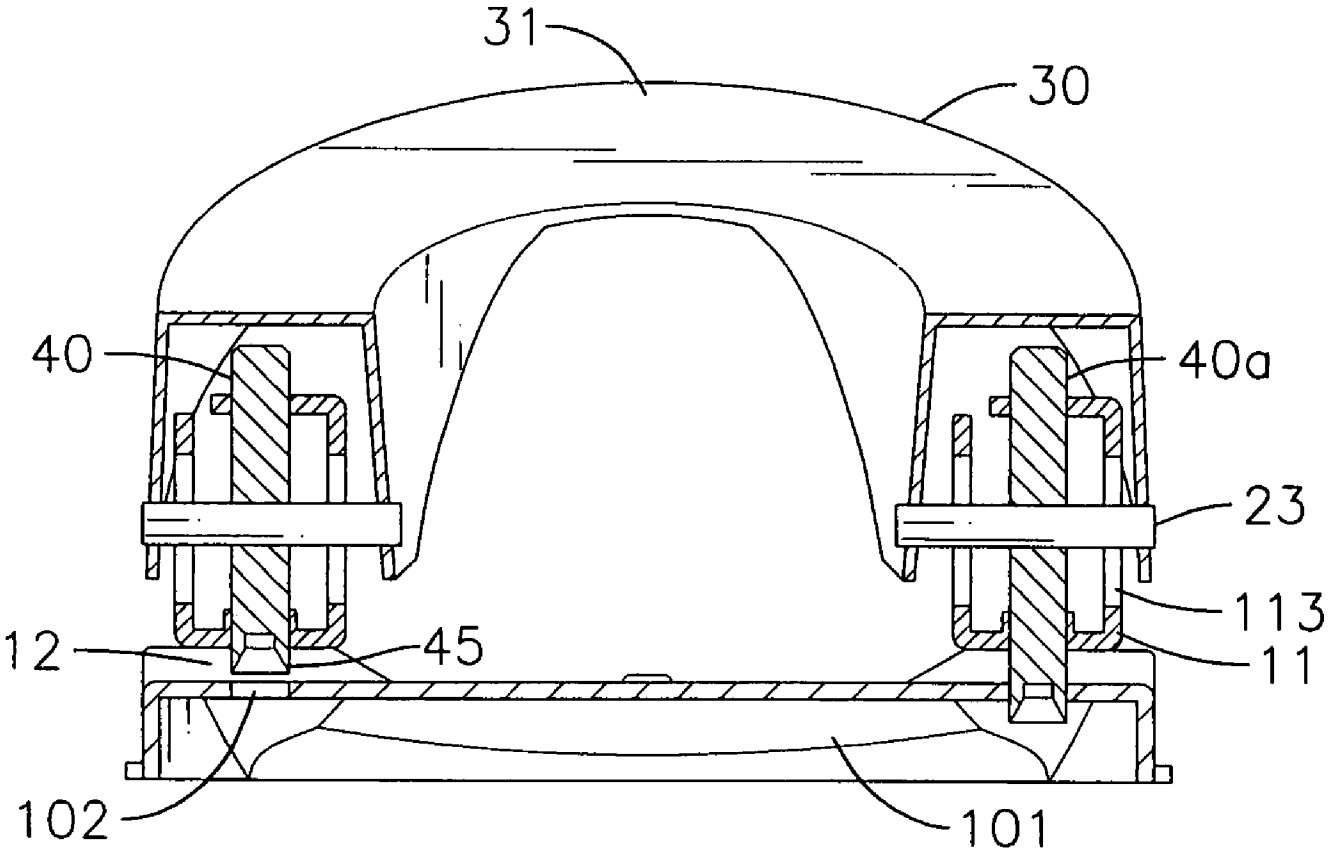
FIG. 5 is an operational cross-sectional front view of the paper punch in FIG. 4.
Figure 6:
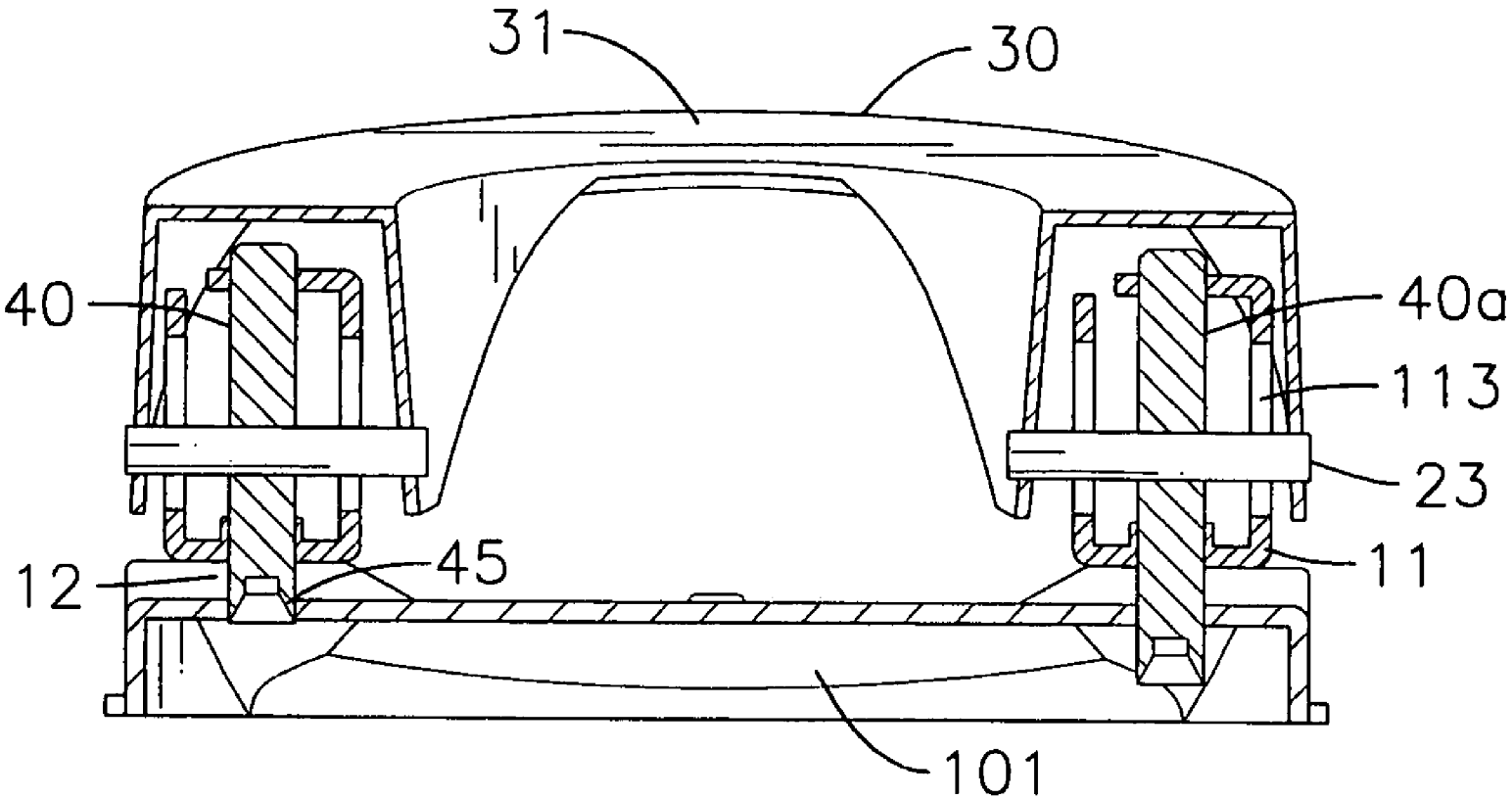
FIG. 6 is an operational cross sectional front view of the paper punch in FIG. 5.

With further reference to FIGS. 5 and 6, the cutters (40, 40*a*) are slidably mounted respectively in the brackets (11) and each cutter (40, 40*a*) has a top end, a bottom end, a blade (45) and a mounting hole (43). The blade (43) is formed on the bottom end of the cutter (40, 40*a*) and may cut paper sheets when the cutters (40, 40*a*) move down through the through holes of the brackets (11) and the punch holes (102) of the base (10). A preferred embodiment of the cutters (40, 40*a*) has the blades (43) mounted at two different levels so that the cutters (40, 40*a*) punch holes through the paper sheets asynchronously. A force needed for a single punch of each cutter (40, 40*a*) is smaller than that needed for a simultaneous dual punch with the blades at the same level. The mounting hole (43) is defined transversely through the cutter (40, 40*a*).

Figure 3:
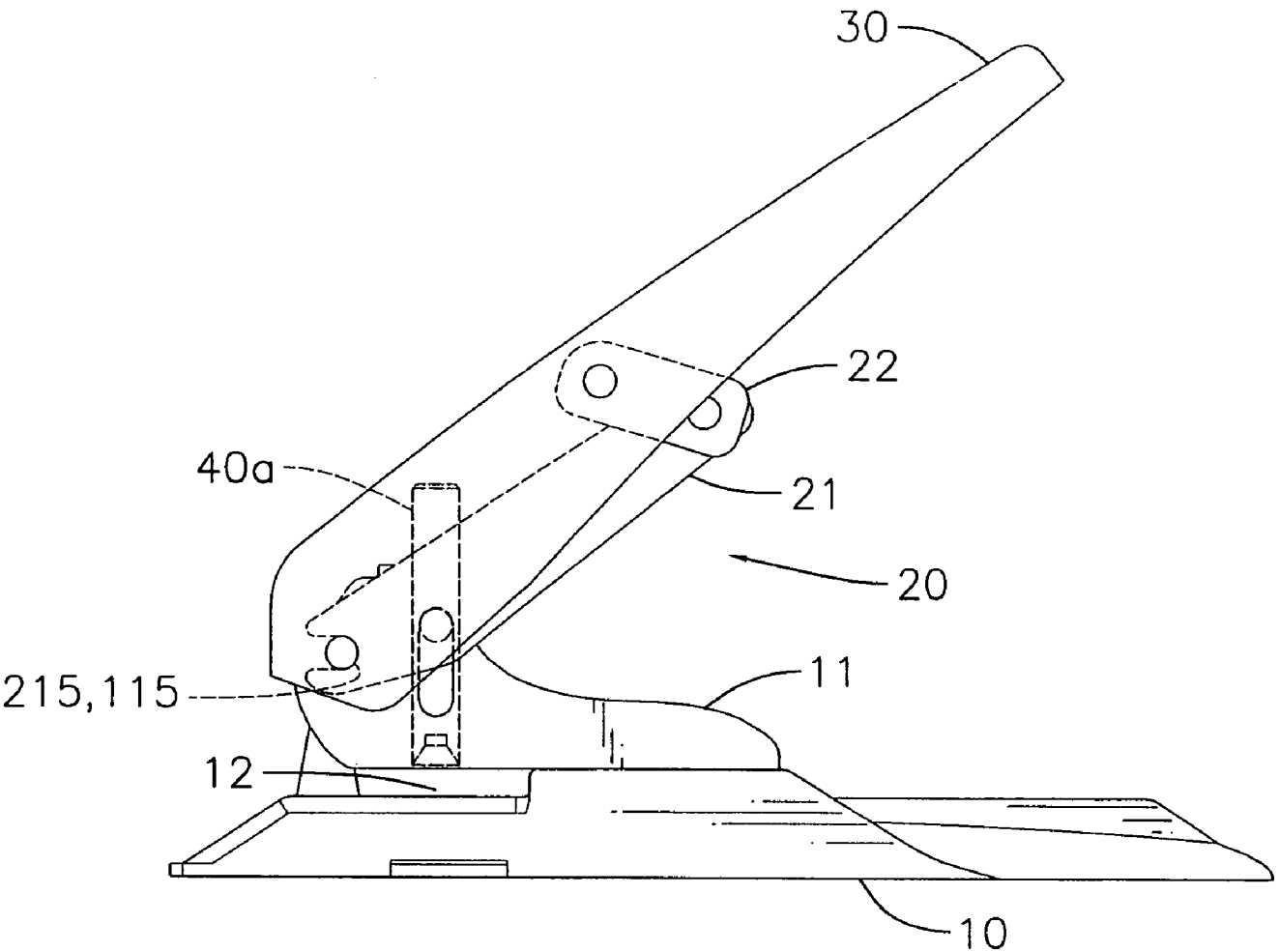
FIG. 3 is a side view of the paper punch in FIG. 1.
Figure 3A:
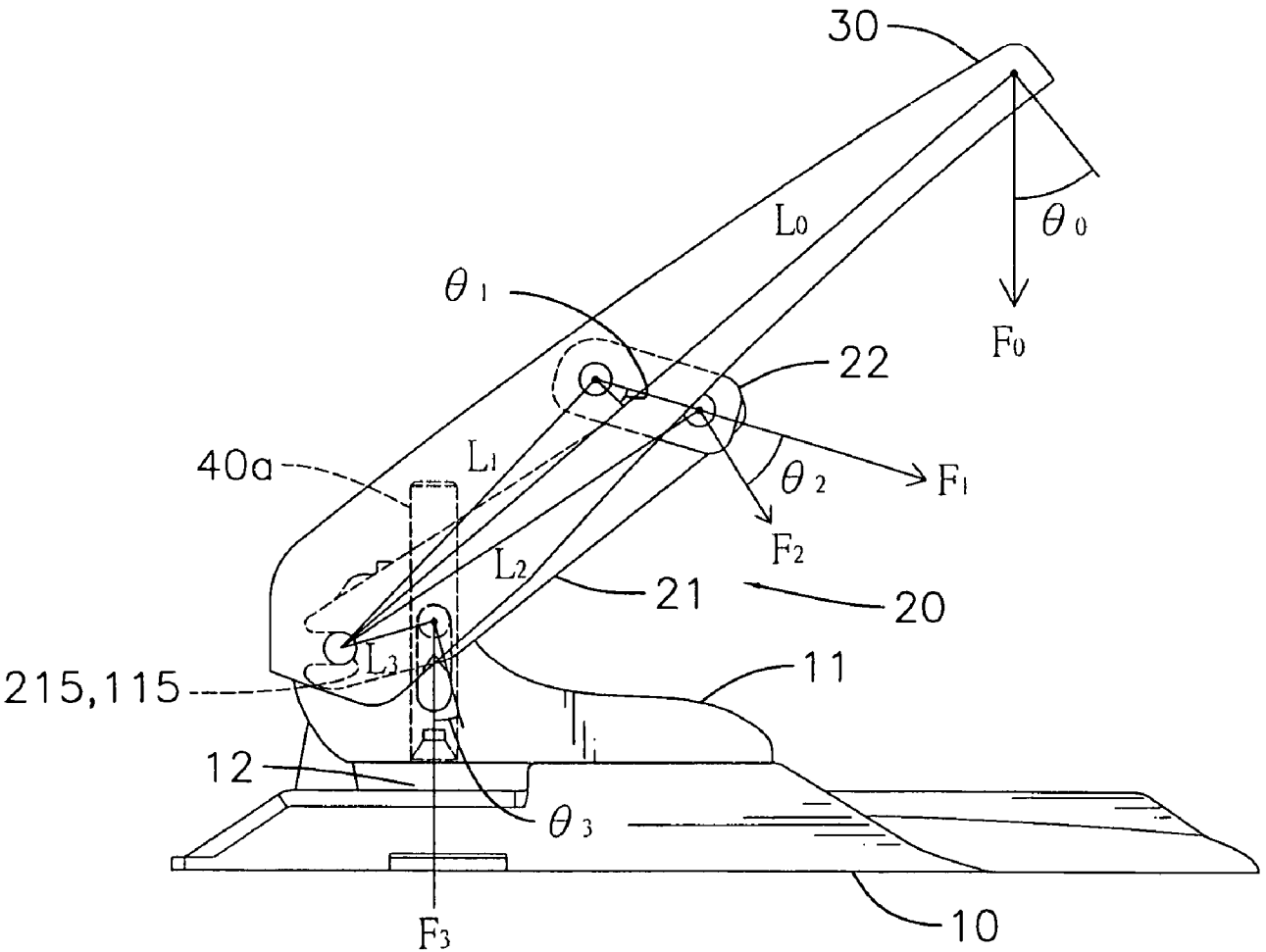
FIG. 3A is a side view of the paper punch in FIG. 3 marked with lines of length of the links and lines of forces applied to the paper punch.

With further reference to FIGS. 3 and 3A, the articulated linkages (20) are pivotally mounted respectively on the brackets (12) on the base (10) and allow a user to press the lever (30) without strenuous effort when punching holes through paper sheets. Each articulated linkage (20) has a lower link (21), an upper link (22) and a connecting pin (23).

Each lower link (21) is mounted pivotally and slidably on a corresponding bracket (11) and has a length ($L_2$), a front end, a rear end, two side tabs (211), two pivot holes and two open pivot slots (215). The length ($L_2$) is 80 units. Each side tab of the lower link (12) has a front end and a rear end. The pivot holes are defined respectively through the side tabs of the lower link (21). The open pivot slots (215) are defined in the front end of the side tabs (211) of the lower link (21).

The upper links (22) are mounted pivotally on the rear end of a corresponding lower link (21). Each upper link (22) has a front end and a rear end. The rear end of an upper link (22) is mounted pivotally on the rear end of a corresponding lower link (21).

The connecting pins (23) extend respectively through the pivot holes in the lower links (21) and the mounting holes (43) of the cutter (40, 40*a*), and are slidably mounted respectively through the guide slots (113) in the brackets (11) to allow the lower links (21) to pivot and slide vertically relative to the brackets (11).

The lever (30) is mounted pivotally to the brackets (11) on the base (10), connected pivotally to the articulated linkages (20) and has a length ($L_0$), a pressing surface (31), two lever arms (32), two pivot pins (35), and two springs (36).

The pressing surface (31) has a front edge.

The lever arms (32) extend from the front edge of the pressing surface (31) and are mounted pivotally to the brackets (11). Each lever arm (32) has a length ($L_1$), a rear end, a front end, two side tabs and two pivot holes (325). The rear end of each lever arm (32) is formed on the front edge of the pressing surface (31) and is connected pivotally to a front end of a corresponding upper link (22). The front end of each lever arm (32) is connected pivotally to a corresponding bracket (11). The pivot holes (325) are defined through the side tabs of each lever arm (32).

The pivot pins (35) extend respectively through the pivot holes (325) of the lever arms (32) and are respectively mounted slidably through the open pivot slots (115, 215) in the brackets (11) and the lower links (21). A distance ($L_3$) between the pivot pin (35) of the lever (30) and a corresponding connecting pin (23) of the articulated linkage (20) is 12.356 units.

The springs (36) are mounted respectively around the pivot pins (35) of the lever (30) and force the lever (10) to incline upward.

To prove that the paper punch saves effort over a conventional paper punch, the following equations are presented to calculate the moment of the paper punch when an external force ($F_0$) is applied to the lever (30).

$$F_0\times\sin(90-\theta_0)\times L_0=F_1\times\sin(90-\theta_1)\times L_1$$

$$F_0\times\sin(53.589°)\times L_0=F_1\times\sin(42.646°)\times L_1$$

$$L_0=115;\ L_1=30$$

$$92.55F_0=20.32F_1$$

$$F_1=4.555F_0$$

$$F_3\times\sin(90-\theta_3)\times L_3=F_2\times L_2$$

$$F_3\times\sin(76.2°)\times L_3=F_2\times L_2$$

$$F_2=F_1\times\sin(90-\theta_2);\ \theta_2=65.059°;\ 90-\theta_2=24.941°$$

$$F_3\times\sin(76.2°)\times L_3=F_1\times\sin(24.941°)\times L_2$$

$$L_2=80;\ L_3=12.356$$

$$11.93F_3=33.735F_1$$

$$F_1=0.354F_3$$

$$4.555F0=0.354F_3$$

$$F_3=12.85F_0$$

An equation for calculating the moment of a conventional paper punch without the articulated linkages (20) are as follows:

$$F_0\times\sin(90-\theta_0)\times L_0=F_3\times\sin(90-\theta_3)\times L_3$$

$$F_0\times\sin(53.589°)\times L_0=F_3\times\sin(76.2°)\times L_3$$

$$L_0=115;\ L_3=12.356$$

$$92.46F_0=11.93F_3$$

$$F_3=7.75F_0$$

$$\text{Effort-saving rate}=[(1/7.75)-(1/12.85)]/(1/7.75)=1-(7.75/12.85)=40\%$$

The articulated linkages (20) are connected to the lever (30) and the base (10) and allow a user to press the lever (30) without strenuous effort when punching holes through paper sheets. Furthermore, the blades (45) of the cutters (40, 40*a*) mounted at different levels allow the cutters (40, 40*a*) to punch holes asynchronously, so each punch of single cutter (40, 40*a*) needs a pressing force smaller than that needed for a simultaneous dual punch of two cutters (40, 40*a*). Therefore, the paper punch is handy.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A paper punch comprising:

a base being hollow and having a top;

an open bottom;

a cavity defined in the base and communicating with the open bottom;

two punch holes defined through the top and communicating with the cavity;

two brackets mounted on the top and each bracket having a bottom;

two side tabs and each side tab having a front end;

a through hole defined through the bottom of the bracket and aligned with a corresponding punch hole in the base;

two guide slots defined respectively through the side tabs; and two open pivot slots defined respectively in the front end of the side tabs; and two gaps defined respectively between the bottom of each bracket and the top of the base;

two cutters mounted slidably and respectively in the brackets and each cutter having a top end, a bottom end, a blade formed on the bottom end and a mounting hole defined transversely through the cutter;

two articulated linkages pivotally mounted respectively on the brackets on the base and each articulated linkage having a lower link mounted pivotally and slidably on a corresponding bracket and having a front end;

a rear end;

two side tabs and each side tab having a front end and a rear end;

two pivot holes defined respectively through the side tabs of the lower link; and two open pivot slots defined in the front end of the side tabs of the lower link;

an upper link mounted pivotally on the rear end of each lower link and each upper link having a front end and a rear end, where the rear end is mounted pivotally on the rear end of a corresponding lower link; and a connecting pin respectively extending through the pivot holes in the lower links and the mounting holes of the cutter and slidably mounted respectively through the guide slots in the brackets; and a lever mounted pivotally on the brackets on the base, connected pivotally to the articulated linkages and having a pressing surface having a front edge;

two lever arms extending from the front edge of the pressing surface, mounted pivotally to the brackets and each lever arm having a rear end formed on the front edge of the pressing surface and connected pivotally to a front end of a corresponding upper link;

a front end connected pivotally to a corresponding bracket;

two side tabs; and two pivot holes defined through the side tabs of the lever arm;

two pivot pins respectively extending through the pivot holes of the lever arms and respectively mounted slidably through the open pivot slots in the brackets and the lower links; and two springs mounted respectively around the pivot pins of the lever to force the lever to incline upward.

2. The paper punch as claimed in claim 1, wherein the blades of the cutters are mounted at two different levels.

* * * * *